United States Patent [19]

Kurosawa et al.

[11] Patent Number: 5,026,316

[45] Date of Patent: Jun. 25, 1991

[54] VARIABLE CAPACITY WOBBLE PLATE COMPRESSOR

[75] Inventors: Juetsu Kurosawa; Katsuhiko Arai, both of Konan, Japan

[73] Assignee: Diesel Kiki Co., Ltd., Tokyo, Japan

[21] Appl. No.: 500,751

[22] Filed: Mar. 28, 1990

[30] Foreign Application Priority Data

Apr. 28, 1989 [JP] Japan ..... 1-50407[U]

[51] Int. Cl.[5] ..... F04B 1/14

[52] U.S. Cl. ..... 417/222; 417/27 D

[58] Field of Search ..... 417/222, 27 D

[56] References Cited

FOREIGN PATENT DOCUMENTS 63-140872 6/1988 Japan .

64-4875 1/1989 Japan .

*Primary Examiner*—Gerald A. Michalsky

*Attorney, Agent, or Firm*—Frishauf, Holtz, Goodman & Woodward

[57] ABSTRACT

A variable capacity wobble plate compressor includes a drive shaft arranged in a housing, bearings arranged in a portion of a cylinder block of the housing toward a crankcase within the housing for rotatably supporting the drive shaft, and a fixing member inserted into a portion of the cylinder block toward a discharge pressure chamber for fixing discharge valves in place. A high pressure-introducing passage is formed through the fixing member and extends from the discharge pressure chamber to the bearings. The high pressure-introducing passage introduces compression medium having high pressure from the discharge pressure chamber to the bearings so that the compression medium having high pressure leaks through the bearings into the crankcase.

13 Claims, 3 Drawing Sheets

VARIABLE CAPACITY WOBBLE PLATE COMPRESSOR

BACKGROUND OF THE INVENTION

This invention relates to a variable capacity wobble plate compressor for compressing refrigerant used in air conditioners for vehicles etc.

Conventional variables capacity wobble plate compressors of this kind have been proposed e.g. by Japanese Provisonal Utility Model Publication (Kokai) No. 64-4875, Japanese Provisional Patent Publication (Kokai) No. 63-140872, etc. which each comprise a drive shaft having opposite ends thereof rotatably supported by respective bearings, a wobble plate mounted on the drive shaft for swinging motion about the drive shaft, discharge valves each disposed to open to allow a refrigerant gas to be discharged into a discharge pressure chamber when pressure within a corresponding cylinder is above a predetermined value, a fixing member fixing the discharge valves in place, and a pressure-control valve arranged in a communicating passage extending between a suction chamber and a crankcase accommodating the wobble plate, for controlling pressure within the crankcase to adjust the inclination angle of the wobble plate, whereby the delivery quantity of capacity of the compressor is varied.

When the pressure-control valve is closed, pressure within the crankcase is inhibited from leaking into the suction chamber, so that high pressure gas leaking through clearances between cylinders and pistons, i.e. blow-by gas is accumulated within the crankcase to increase the pressure within the crankcase. As the pressure within the crankcase increases, the inclination angle of the wobble plate decreases to shorten the stroke of the pistons to thereby decrease the capacity of the compressor.

In these proposed variable capacity wobble plate compressors, for the purpose of compensating for insufficient pressure-increasing effect of the blow-by gas, a high pressure-introducing passage is provided for introducing high pressure from the discharge pressure chamber into the crankcase to thereby increase the pressure within the crankcase to a sufficient level.

However, in the conventional compressors, the high pressure-introducing passage is formed by providing through holes having the same diameter in a rear head, a valve plate, and a cylinder block, respectively, which makes the related parts complicated in construction and hence the machining thereof difficult to carry out.

SUMMARY OF THE INVENTION

It is the object of the invention to provide a variable capacity wobble plate compressor having a high pressure-introducing passage for introducing high pressure from the discharge pressure chamber into the crankcase, which can easily machined.

To attain the above object, the present invention provides a variable capacity wobble plate compressor including a housing having a cylinder block, the cylinder block having a plurality of cylinders formed therethrough, the housing having a discharge pressure chamber, a suction chamber, and a crankcase defined therein, a discharge valve provided at each of the cylinders for allowing compressed compression medium to be discharged from the each cylinder into the discharge pressure chamber when it is open, a drive shaft arranged in the housing, bearing means arranged in a portion of the cylinder block toward the crankcase for rotatably supporting the drive shaft, a wobble plate accommodated within the crankcase and mounted on the drive shaft for swinging motion about the drive shaft, a fixing member inserted into a portion of the cylinder block toward the discharge pressure chamber for fixing the discharge valves in place, a communicating passage extending between the crankcase and the suction chamber, and a pressure-control valve disposed across the communicating passage for adjusting pressure of the compression medium within the crankcase to change the inclination angle of wobble plate whereby the delivery quantity or capacity of the compressor is varied.

The variable capacity wobble plate compressor according to the invention is characterized by comprising a high pressure-introducing passage formed through the fixing member and extending from the discharge pressure chamber of the bearing means, the high pressure-introducing passage introducing the compression medium having high pressure from the discharge pressure chamber to the bearing means so that the compression medium having high pressure leaks through the bearing means into the crankcase.

Preferably, the high pressure-introducing passage is coaxial with the drive shaft.

More preferably, the high pressure-introducing passage has a restriction therein.

Preferably, the fixing member is arranged in a first hole formed in the cylinder block and extending coaxially with the drive shaft.

Further preferably, the bearing means is arranged in a second hole formed in the cylinder block and communicating with the first hole, for rotatably supporting one end of the drive shaft toward the cylinder block.

Still more preferably, the bearing means comprises a radial bearing and a thrust bearing, the second hole comprising two holes having different diameters in which the radial bearing and the thrust bearing are respectively arranged.

Preferably, the second hole has a diameter larger than that of the first hole, the second hole having an axial projection formed on an end face thereof toward the first hole, the compressor including a conical washer interposed between the axial projection and one end face of the drive shaft toward the cylinder block, the conical washer having an opening formed in a central portion thereof.

More preferably, the compressor includes a hinge ball interposed between the wobble plate and the drive shaft for supporting the wobble plate for swinging about the drive shaft, and the drive shaft has a communicating hole formed therein and extending substantially along an axis thereof, the communicating hole extending from one end face of the drive shaft toward the cylinder block for introducing the compression medium under high pressure into the communicating hole, the communicating hole having a radial guide passage opening at a portion of the drive shaft in the vicinity of the hinge ball, for guiding the compression medium under high pressure to the hinge ball.

Still more preferably, the compressor includes second bearing means rotatably supporting another end of the drive shaft, and the commuicating hole has a radial guide passage opening in the another end of the drive shaft, for guiding the compression medium under high pressure to the second bearing means.

The above and other objects, features, and advantages of the invention will be more apparent from the ensuing detailed description taken in conjunction with the accompanying drawings.

DETAILED DESCRIPTION

The invention will now be described in detail with reference to the drawings showing preferred embodiments thereof.

Figure 1:
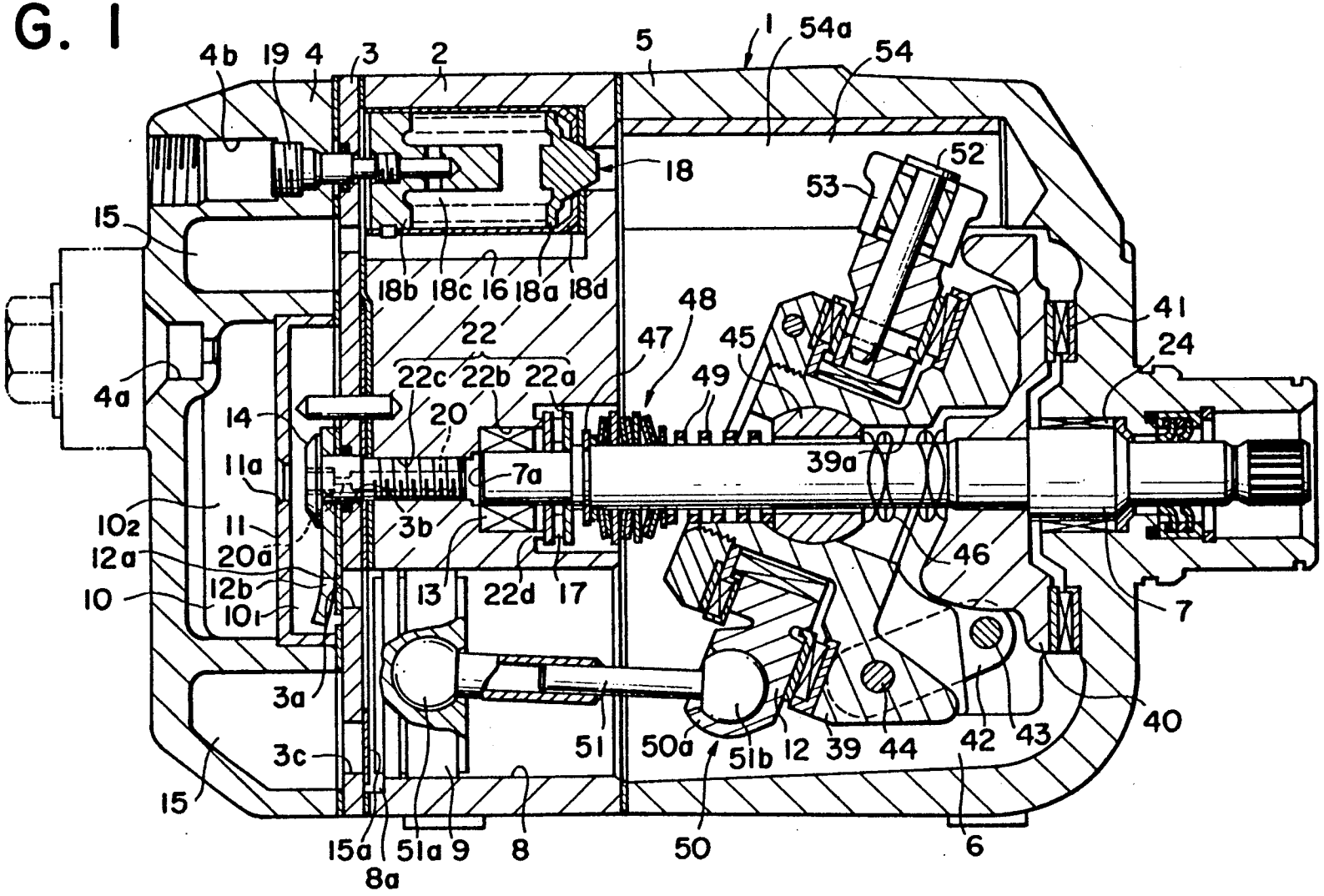
FIG. 1 is a longitudinal cross-sectional view of a variable capacity wobble plate compressor according to a first embodiment of the invention.

Referring first to FIG. 1, there is illustrated a variable capacity wobble plate compressor according to a first embodiment of the invention. In the figure, reference numeral 1 designates a compressor housing, which is formed of a cylinder block 2, a rear head 4 secured in an airtight manner to a left end face of the cylinder block 2 as viewed in FIG. 1 through a valve plate 3, and a front head 5 secured in an airtight manner to a right end face of of the cylinder block 2. A crankcase 6 is defined within the interior of the housing 1 by an end face of the cylinder block 2 facing toward the front head 5, and an inner peripheral wall and an inner end wall of the front head 5. A drive shaft 7 is arranged within the housing 1 and extends substantially along the axis of the housing. The drive shaft 7 is rotatably supported by radial bearings 13, 24. A plurality of cylinders 8 are formed in the cylinder block 2 in circumferentially equally spaced relation and extend with their respective axes parallel with the axis of the drive shaft 7, and in each of which is slidably fitted a piston 9. A cylinder chamber **8*a* for compressing refrigerant is defined by corresponding part of a cylinder block side end face of the valve plate 3, each corresponding cylinder, and each corresponding piston 9**.

Formed in a left end face of the rear head 4 is a discharge port **4*a* through which compressed refrigerant gas is discharged. Defined in a substantially central portion of the rear head 4 is a discharge pressure chamber 10 which is divided into a first discharge pressure chamber $\mathbf{10_1}$ and a second discharge pressure chamber $\mathbf{10_2}$ by a partition wall 11. The first and second discharge pressure chambers $\mathbf{10_1}$ and $\mathbf{10_2}$ communicate with each other through a restriction hole 11*a* provided in the partition wall 11. Outlet ports 3*a* are formed through the valve plate 3 to communicate between the respective cylinders 8 and the first discharge pressure chamber $\mathbf{10_1}$. The outlet ports 3*a* communicate with the discharge port 4*a* via the first discharge pressure chamber $\mathbf{10_1}$, the restriction hole 11*a*, and the second discharge pressure chamber $\mathbf{10_2}$ in the mentioned order. The outlet ports 3*a* are opened and closed by means of respective discharge valves 12*a*. The discharge valves 12*a* are fixed to an end face of the valve plate 3 facing the rear head 4 together with valve stoppers 12*b* by means of a bolt (fixing member) 14 which is screwed by way of a hole 3*b* formed through the valve plate 3 into a reduced-diameter hole 22*c* formed in the cylinder block 2. The bolt 14 has a high pressure-introducing passage 20 formed therein and extending substantially along the axis thereof. The high pressure-introducing passage 20 has a restriction 20*a* at an intermediate portion thereof which restricts the flow rate of the refrigerant gas under discharge pressure Pd (high pressure) introduced toward the radial bearing 13. A suction chamber 15 is formed around the discharge pressure chamber 10 in the rear head 4, which communicates with the cylinders 8 through respective inlet port 3*c* formed through the valve plate 3. The inlet ports 3*c* are opened and closed by means of respective suction valves 15*a* which are mounted on an end face of the valve plate 3 on the cylinder block 2** side.

The suction chamber 15 communicates with the outlet of an evaporator, not shown, of the air conditioning system through a suction port, not shown, while the discharge pressure chamber 10 communicates with the inlet of a condenser, not shown, of the air conditioning system through the discharge port **4*a***.

The cylinder block 2 has a communicating hole 22 formed through a substantially central portion thereof and extends coaxially with the drive shaft 7. The communicating hole 22 consists of an increased-diameter hole **22*a*, a medium-diameter hole 22*b*, and the reduced-diameter hole 22*c* referred to hereinabove, arranged in the mentioned order from the front head 5 side to the rear head 4 side. The radial bearing 13 is arranged in the medium-diameter hole 22*b*, while a thrust bearing 17 is arranged in the increased-diameter hole 22*a***.

Further formed through the cylinder block 2 is a communicating passage 16 which communicates between the suction chamber 15 and the crankcase 6. Arranged across the communicating passage 16 is a pressure-control valve 18 which comprises a valve body **18*a*, a support 18*b*, a bellows 18*c* interposed between the valve body 18*a* and the support 18*b*, and a cylindrical member 18*d* accommodating these parts 18*a*, 18*b*, and 18*c*. A pressure-regulating screw 19 adjusts the setting pressure of the pressure-control valve 18, in accordance with which the valve body 18*a* opens and closes the communicating passage 16 to adjust the differential pressure between pressure in the suction chamber 15 and pressure in the crankcase 6**.

A rotary retainer 40 is fitted around the drive shaft 7 at a location adjacent the front head 5 for transmitting the rotation of the drive shaft 7 to a wobble plate support member 39. The rotary retainer 40 is rotatably axially supported by the front head 5 via a thrust bearing 41. The rotary retainer 40 is connected with the wobble plate support member 39 by means of a link arm 42 pivotably joined to the both members 39 and 40. To be specific, the link arm 42 has one end thereof pivoted by means of a pin 43 to a peripheral lower portion of the rotary retainer 40 and the other end by means of a pin 44 to a peripheral lower portion of the wobble plate support member 39.

The wobble plate support member 39 has a central through hole **39*a* formed therein, in which the drive shaft 7 is freely fitted. A hinge ball 45, which is axially slidably fitted on an axially intermediate portion of the drive shaft 7, is slidably fitted in the central through hole 39*a* of the support member 39. Fitted on a portion of the drive shaft 7 between the hinge ball 45 and the rotary retainer 40 is a spring 46 urging the hinge ball 45 leftward as viewed in FIG. 1, i.e. toward the cylinder block 2. A stopper 47 is rigidly secured on an end of the drive shaft 7 toward the cylinder block 2. A plurality of coned disc springs 48 and a coiled spring 49** are interposed around the drive shaft 7 between the stopper 47 and the hinge ball 45 in the mentioned order, urging the hinge ball 45 toward the front head or rightward as viewed in FIG. 1.

A wobble plate 50 is rotatably mounted on the wobble plate support member 39. Each of the pistons 9 is pivotably joined to a peripheral edge portion 50*a* of the wobble plate 50 by means of a piston rod 51 having opposite end balls 51*a*, 51*b* pivotally fitted in respective associated ends of the piston and the peripheral edge portion of the wobble plate 50. Thus, as the drive shaft 7 rotates to cause rotation of the rotary retainer 40 and the wobble plate support member 39, the wobble plate 50 is axially swung about the hinge ball 45, to cause the pistons 9 to reciprocate within their respective cylinders 8 via the respective piston rods 51, whereby the refrigerant gas is sucked and compressed.

A restraint pin 52 is inserted onto an outer peripheral surface of the wobble plate 50 in a manner inwardly extending to a location close to the axis of the wobble plate 50. A slipper 53 is rotatably fitted on a radially outer end portion of the restraint pin 52.

A channel 54 having a pair of parallel guide surfaces 54*a*, only one of which is shown, is formed in an inner peripheral surface of the housing 1 facing the slipper 53 and extends from the end face of the cylinder block 2 facing toward the front head 5 to an opposed inner surface of the front head 5 in a direction parallel to the axis of the drive shaft 7. Thus, the restraint pin 52 and the slipper 53 are moved along the channel 54 together with the swinging wobble plate 50. That is, the wobble plate is inhibited from making circumferential motion relative to the drive shaft 7 but is allowed to make axially swinging motion about the hinge ball 45 in directions parallel to the axis of the drive shaft 7.

The operation of the variable capacity wobble plate compressor of the first embodiment of the invention constructed as above will be described below.

When the rotational power of the automotive engine, not shown, is transmitted to the drive shaft 7, the drive shaft 7 rotates together with the rotary retainer 40 and the wobble plate support member 39. With the rotation of the drive shaft 7, the wobble plate 50 is swung about the hinge ball 45 in the directions parallel to the axis of the drive shaft 7. The inclination angle of the wobble plate varies with change in pressure Pw in the crankcase 6, whereby the stroke length of the pistons 9 is varied to vary the delivery quantity or capacity. To be specific, with a decrease in the pressure Pw in the crankcase, the inclination angle of the wobble plate increases, which increases the stroke length of the pistons 9 to increase the delivery quantity or capacity. On the other hand, with an increase in the pressure Pw in the crankcase, the inclination angle of the wobble plate 50 decreases, which decreases the stroke length of the pistons 9 to decrease the delivery quantity or capacity.

When the pressure-control valve 18 opens, the refrigerant gas within the crankcase 6 leaks into the suction chamber 15 via the communicating passage 16, so that the pressure Pw within the crankcase 6 decreases. With the decrease in the pressure Pw within the crankcase 6, the inclination angle of the wobble plate 50 increases, which also increases the stroke length of the pistons 9 to increase the delivery quantity or capacity.

On the other hand, when the pressure-control valve 18 closes, the refrigerant gas within the crankcase 6 is inhibited from leaking into the suction chamber 15, so that the blow-by gas is stored up in the crankcase to thereby increase the pressure Pw within the crankcase 6. At the same time, the refrigerant gas under discharge pressure Pd leaks through the high pressure-introducing passage 20 of te bolt 14 and then through clearances in the radial bearing 13 and the thrust bearing 17 into the crankcase 6. The refrigerant gas under the discharge pressure Pd having entered the high pressure-introducing passage 20 has its flow rate restricted by the restriction 20*a*, and then advances toward a central portion of an end face 7*a* of the drive shaft 7. Upon reaching the central portion of the end face 7*a*, the refrigerant gas radially diverges along the end face 7*a* of the drive shaft 7, and then passes through clearances in the radial bearing 13 and the thrust bearing 17 to leak into the crankcase 6. As a result, the refrigerant gas is evenly supplied to the whole radial bearing 13 and the whole thrust bearing 17 to lubricate same and also cool same by absorption of heat due to expansion of the refrigerant gas, and at the same time the pressure Pw in the crankcase 6 is promptly and sufficiently increased to decrease the inclination angle of the wobble plate 50, so that the stroke length of the pistons 9 is decreased to decrease the delivery quantity or capacity.

According to this embodiment, the high pressure-introducing passage 20 is formed through the bolt 14 to introduce refrigerant gas under the discharge pressure Pd to the radial bearing 13 and the thrust bearing 17 to leak the refrigerant gas through the clearances in the radial bearing 13 and the thrust bearing 17 into the crankcase 6. Therefore, it is unnecessary to form the high pressure-introducing passage by providing through holes having the same diameter through component parts of the compressor, such as the rear head 4, the valve plate 3, and the cylinder block 2, by precision machining, which facilitates the machining of the high pressure-introducing passage. Further, since the high pressure-introducing passage 20 is coaxial with the drive shaft 7, the refrigerant gas having passed the hight pressure-introducing passage 20 hits against the central portion of the end face 7*a* of the drive shaft, and then radially diverges along the end face 7*a*, so that the refrigerant gas is evenly supplid to the whole radial bearing 13 and the whole thrust bearing 17, which results in good lubrication of the bearings 13 and 17 and cooling of same.

Figure 2:
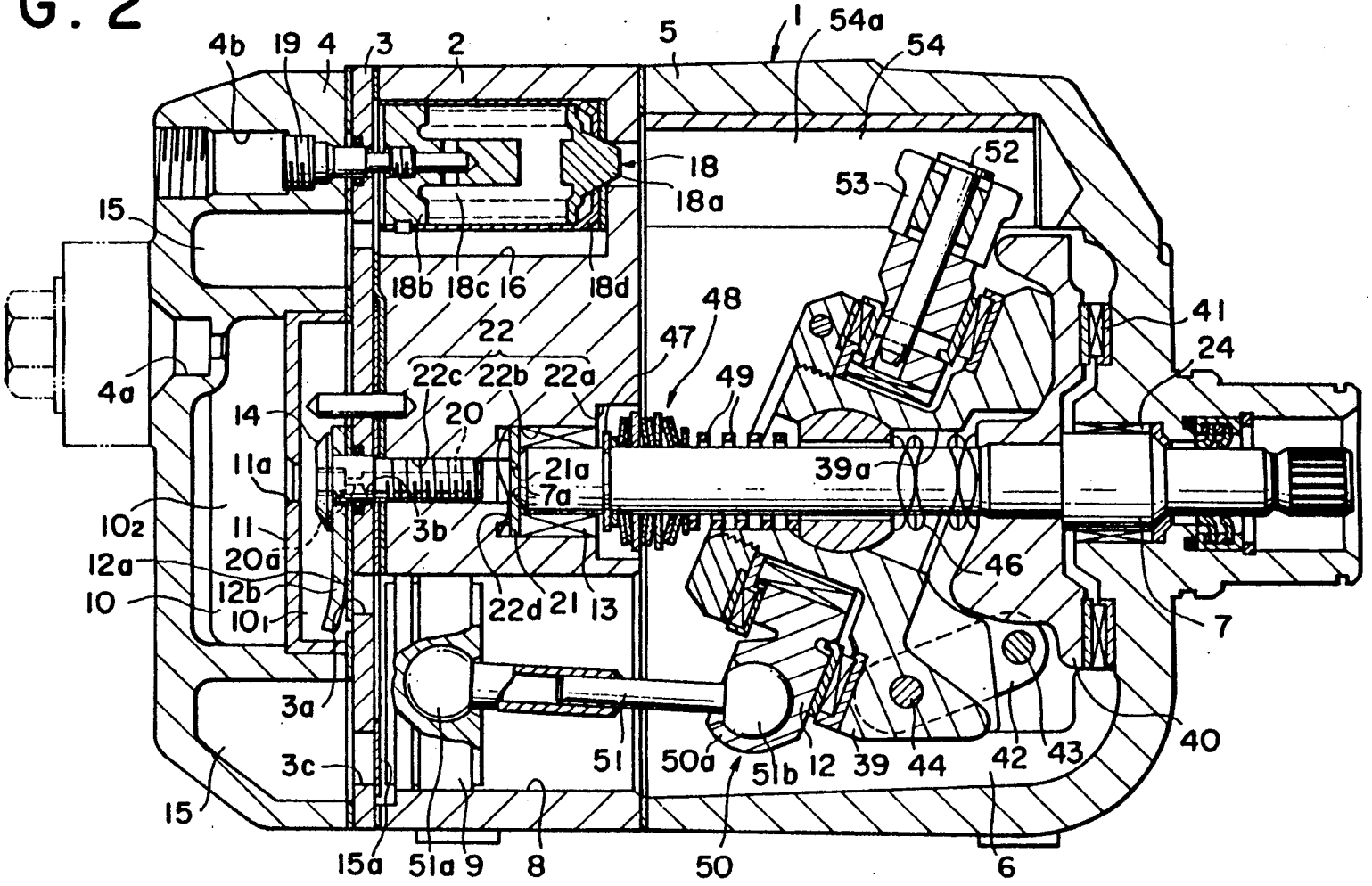
FIG. 2 is a longitudinal cross-sectional view of a variable capacity wobble plate compressor according to a second embodiment of the invention.

FIG. 2 shows a variable capacity wobble plate compressor according to a second embodiment of the invention. This embodiment is distinguished from the first embodiment described above in that a pre-loading conical washer 21 having a central through hole 21*a* is inserted between the end face 7*a* of the drive shaft 7 and an axial projection 22*d* formed on a rear head 4 side end face of the medium-diameter hole 22*b*, and that the thrust bearing 17 is omitted. According to this embodiment, the same results as those in the first embodiment can be obtained.

Figure 3:
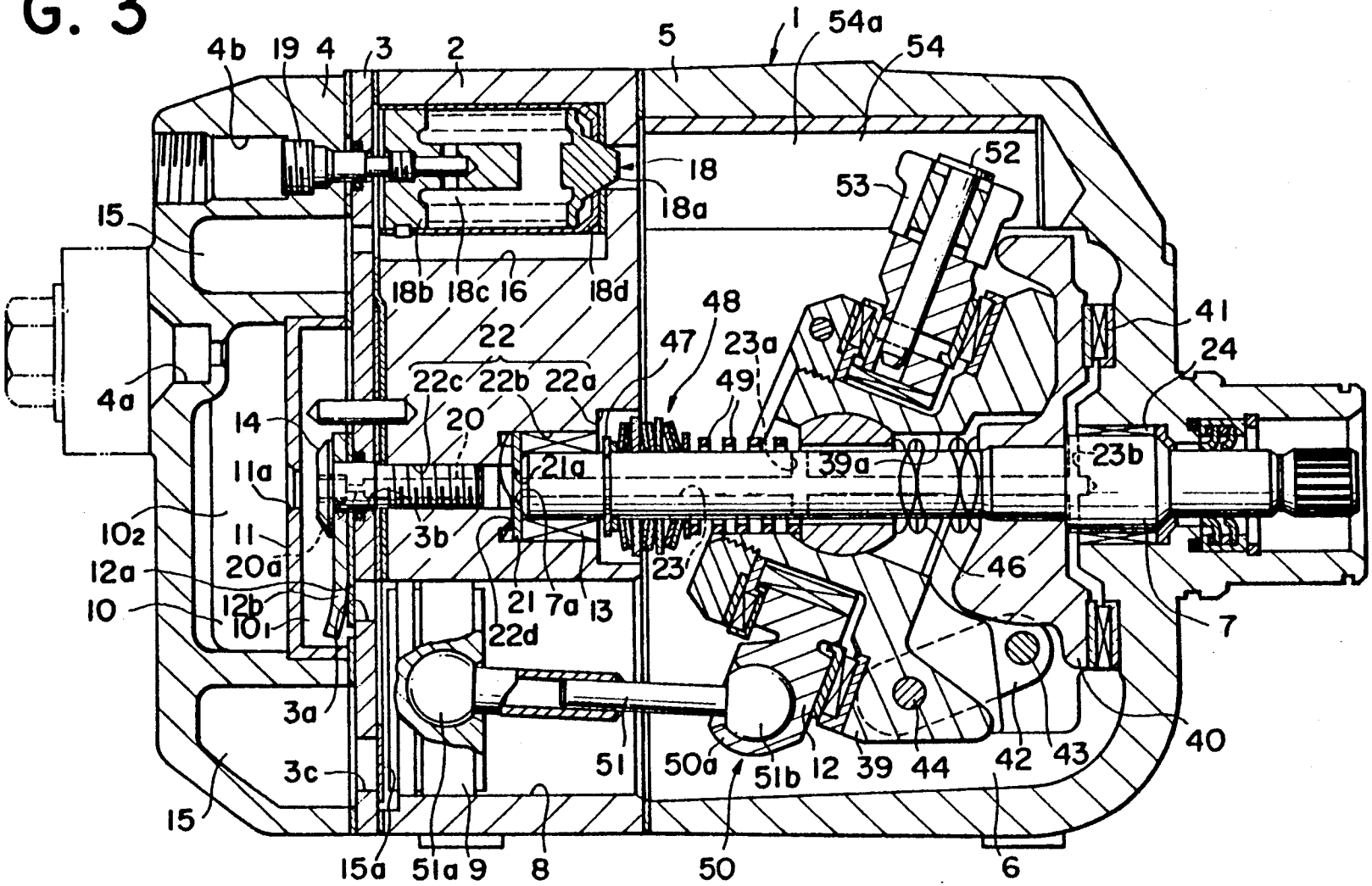
FIG. 3 is a longitudinal cross-sectional view of a variable capacity wobble plate compressor according to a third embodiment of the invention.

FIG. 3 shows a variable capacity wobble plate compressor according to a third embodiment of the invention. This embodiment is distinguished from the second embodiment in that a communicating hole 23 is formed in the drive shaft 7 and extends along its axis, which opens in an end face of the drive shaft 7 toward the cylinder block 2 and has a radial guide passage 23*a* at an intermediate portion thereof, which guides refrigerant gas to the hinge ball 45, and another radial guide passage 23*b* in the vicinity of a terminating portion of the communicating hole 23, which guides refrigerant gas to the radial bearing 24. According to this embodiment, not only the same results as those in the second embodiment can be obtained, but also refrigerant gas can be supplied to the hinge ball 35 and the radial bearing 24 as well as the radial bearing 13 to effect good lubrication of these bearings.

What is claimed is:

1. In a variable capacity wobble plate compressor including a housing having a cylinder block, said cylinder block having a plurality of cylinders formed therethrough, said housing having a discharge pressure chamber, a suction chamber, and a crankcase defined therein, a discharge valve provided at each of said cylinders for allowing compressed compression medium to be discharged from said each cylinder into said discharge pressure chamber when it is open, a drive shaft arranged in said housing, bearing means arranged in a portion of said cylinder block toward said crankcase for rotatably supporting said drive shaft, a wobble plate accommodated within said crankcase and mounted on said drive shaft for swinging motion about said drive shaft, a fixing member inserted into a portion of said cylinder block toward said discharge pressure chamber for fixing said discharge valves in place, a communicating passage extending between said crankcase and said suction chamber, and a pressure-control valve disposed across said communicating passage for adjusting pressure of said compression medium within said crankcase to change the inclination angle of said wobble plate whereby the delivery quantity or capacity of said compressor is varied, the improvement comprising a high pressure-introducing passage formed through said fixing member and extending from said discharge pressure chamber to said bearing means, said high pressure-introducing passage introducing said compression medium having high pressure from said discharge pressure chamber to said bearing means so that said compression medium having high pressure leaks through said bearing means into said crankcase.

2. A variable capacity wobble plate compressor according to claim 1, wherein said high pressure-introducing passage is coaxial with said drive shaft.

3. A variable capacity wobble plate compressor according to claim 2, wherein said high pressure-introducing passage has a restriction therein.

4. A variable capacity wobble plate compressor according to claim 2, wherein said fixing member is arranged in a first hole formed in said cylinder block and extending coaxially with said drive shaft.

5. A variable capacity wobble plate compressor according to claim 1, wherein said high pressure-introducing passage has a restriction therein.

6. A variable capacity wobble plate compressor according to claim 1, wherein said fixing member is arranged in a first hole formed in said cylinder block and extending coaxially with said drive shaft.

7. A variable capacity wobble plate compressor according to claim 6, wherein said bearing means is arranged in a second hole formed in said cylinder block and communicating with said first hole, for rotatably supporting one end of said drive shaft toward said cylinder block.

8. A variable capacity wobble plate compressor according to claim 7, wherein said bearing means comprises a radial bearing and a thrust bearing, said second hole comprising two holes having different diameters in which said radial bearing and said thrust bearing are respectively arranged.

9. A variable capacity wobble plate compressor according to claim 8, including a hinge ball interposed between said wobble plate and said drive shaft for supporting said wobble plate for swinging about said drive shaft, and wherein said drive shaft has a communicating hole formed therein and extending substantially along an axis thereof, said communicating hole extending from one end face of said drive shaft toward said cylinder block for introducing said compression medium under high pressure into said communicating hole, said communicating hole having a radial guide passage opening at a portion of said drive shaft in the vicinity of said hinge ball, for guiding said compression medium under high pressure to said hinge ball.

10. A variable capacity wobble plate compressor according to claim 9, including second bearing means rotatably supporting another end of said drive shaft, and wherein said communicating hole has a radial guide passage opening in said another end of said drive shaft, for guiding said compression medium under high pressure to said second bearing means.

11. A variable capacity wobble plate compressor according to claim 7, wherein said second hole has a diameter larger than that of said first hole, said second hole having an axial projection formed on an end face thereof toward said first hole, said compressor including a conical washer interposed between said axial projection and one end face of said drive shaft toward said cylinder block, said conical washer having an opening formed in a central portion thereof.

12. A variable capacity wobble plate compressor according to claim 5, including a hinge ball interposed between said wobble plate and said drive shaft for supporting said wobble plate for swinging about said drive shaft, and wherein said drive shaft has a communicating hole formed therein and extending substantially along an axis thereof, said communicating hole extending from one end face of said drive shaft toward said cylinder block for introducing said compression medium under high pressure into said communicating hole, said communicating hole having a radial guide passage opening at a portion of said drive shaft in the vicinity of said hinge ball, for guiding said compression medium under high pressure to said hinge ball.

13. A variable capacity wobble plate compressor according to claim 12, including second bearing means rotatably supporting another end of said drive shaft, and wherein said communicating hole has a radial guide passage opening in said another end of said drive shaft, for guiding said compression medium under high pressure to said second bearing means.

* * * * *